United States Patent [19]

Cho

[11] 4,381,587

[45] May 3, 1983

[54] APPARATUS FOR CORRECTING DEVIATION OF TRAVELLING FABRICS

[76] Inventor: Hideyuki Cho, c/o Toyo Machinery Co. Ltd., No. 29-6, Zuiko-dori, Higashiyodogawa-ku, Osaka-shi, Japan

[21] Appl. No.: 190,406

[22] Filed: Sep. 24, 1980

[30] Foreign Application Priority Data

Oct. 1, 1979 [JP] Japan ..... 54-126975

[51] Int. Cl.[3] ..... D06C 3/06

[52] U.S. Cl. ..... 26/78; 26/97; 226/17

[58] Field of Search ..... 26/78, 97; 226/17

[56] References Cited

U.S. PATENT DOCUMENTS

| | | | |
|---|---|---|---|
| 1,875,777 | 9/1932 | Tackaberry | 26/97 X |
| 4,007,865 | 2/1977 | Crandall | 26/97 X |
| 4,097,973 | 7/1978 | Cho | 26/78 |

FOREIGN PATENT DOCUMENTS

| | | | |
|---|---|---|---|
| 1117076 | 11/1961 | Fed. Rep. of Germany | 26/78 |
| 575390 | 10/1977 | U.S.S.R. | 26/78 |

*Primary Examiner*—Robert Mackey

*Attorney, Agent, or Firm*—Larson and Taylor

[57] ABSTRACT

An apparatus comprising a fixed roller and a movable roller movable toward and away from the fixed roller to correct the deviation of a travelling fabric by nipping a selvage thereof with the two rollers. The movable roller is biased by a spring toward the fixed roller for nipping the fabric but is normally held away from the fixed roller by a forward stroke of a cylinder against the action of the spring. The spring is provided with a member for adjusting the spring force, and the stroke of the cylinder is also adjustable. The axis of the movable roller is slightly shiftable automatically relative to the fixed roller to assure proper nipping engagement with the fabric.

8 Claims, 10 Drawing Figures

APPARATUS FOR CORRECTING DEVIATION OF TRAVELLING FABRICS

BACKGROUND OF THE INVENTION

Apparatus are already known which comprise a fixed roller and a movable roller disposed in opposed relation to the fixed roller and movable toward and away therefrom for correcting the deviation of a travelling fabric by nipping the fabric with the two rollers when necessary.

With such a known deviation correcting apparatus, the movable roller is held away from the fixed roller by the action of a spring. When the selvage of a travelling fabric for which the apparatus is provided deviates toward the center line of the path of travel of the fabric, the movable roller is forced toward the fixed roller by a push rod on a diaphragm cylinder to nip the selvage with the two rollers for the correction of the deviation.

However, since the rollers are adapted to nip the selvage by the pressure of fluid supplied to the diaphragm cylinder, the nipping action invariably involves a time delay corresponding to the time taken for the supply of the fluid. Thus the selvage is actually nipped some time after the moment when it must be nipped. The delay of timing therefore substantially impairs the accuracy of deviation correction.

SUMMARY OF THE INVENTION

The present invention relates to an apparatus for correcting the deviation of travelling fabrics, and more particularly to improvements in means for moving a movable roller toward and away from a fixed roller.

An object of this invention is to provide an apparatus comprising a fixed roller and a movable roller which is biased toward the fixed roller by a spring for nipping a travelling fabric and which is normally held away from the fixed roller by a cylinder operable as associated with means for detecting the deviation of the fabric, so that the fabric can be nipped by the rollers with high sensitivity under the action of the spring for the correction of the deviation of the fabric with remarkably improved accuracy.

Another object of the invention is to provide an apparatus of the type described in which the spring is provided with means for adjusting the resilience thereof so that even when the apparatus is used under varying conditions in respect of the speed of travel of the fabric, the thickness thereof, etc., the fabric can be nipped with high sensitivity in conformity with the conditions involved, the apparatus thus being adapted to correct the deviation of travelling fabrics with greatly improved efficiency.

Another object of the invention is to provide an apparatus of the type described which includes means for adjusting the spacing between the fixed roller and the movable roller opposed thereto so that even when the apparatus is used for a fabric having an uneven thickness or defects such as slubs, the fabric can be nipped properly with high sensitivity to ensure correction of the deviation thereof with remarkably improved efficiency.

Still another object of the invention is to provide an apparatus of the type described which includes means for slightly tilting or inclining the movable roller relative to the fixed roller to properly position the movable roller automatically relative to the fixed roller to assure correction of the deviation of travelling fabrics with greatly improved efficiency and accuracy.

DESCRIPTION OF THE PREFERRED EMBODIMENT

Figure 1:
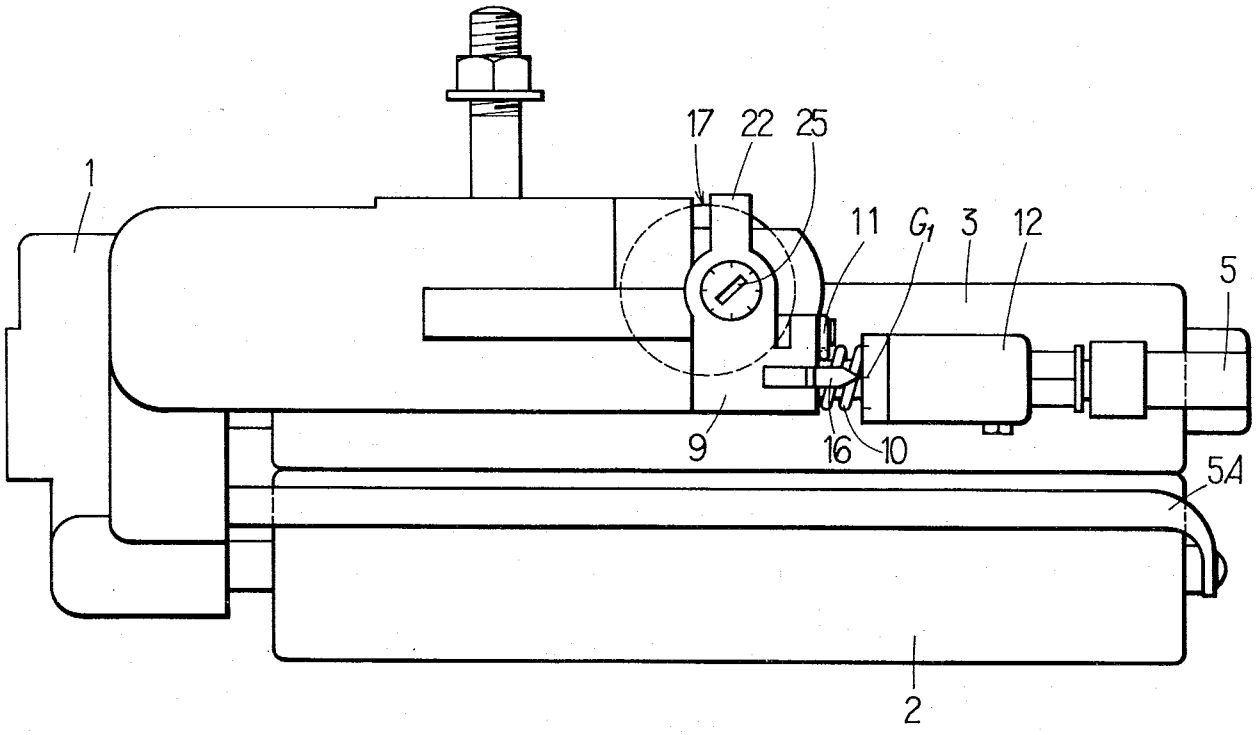
FIG. 1 is a plan view showing an embodiment of the present invention.
Figure 2:
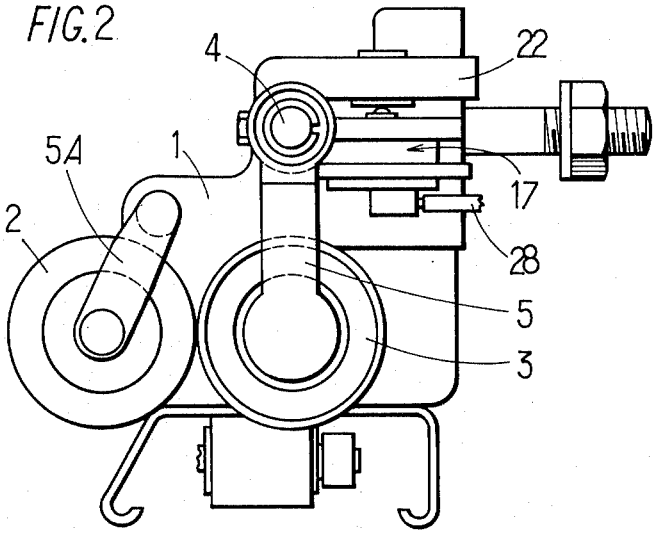
FIG. 2 is a side elevation of the same.

With reference to FIGS. 1 and 2, a fixed roller 2 and a movable roller 3 are supported by a frame 1 as arranged side by side in parallel to each other.

The fixed roller 2 has a urethane covering and a shaft which is rotatably supported at its opposite ends by unillustrated bearings, such as bushes, on a bearing arm 5A fixed to the frame 1.

Figure 3:
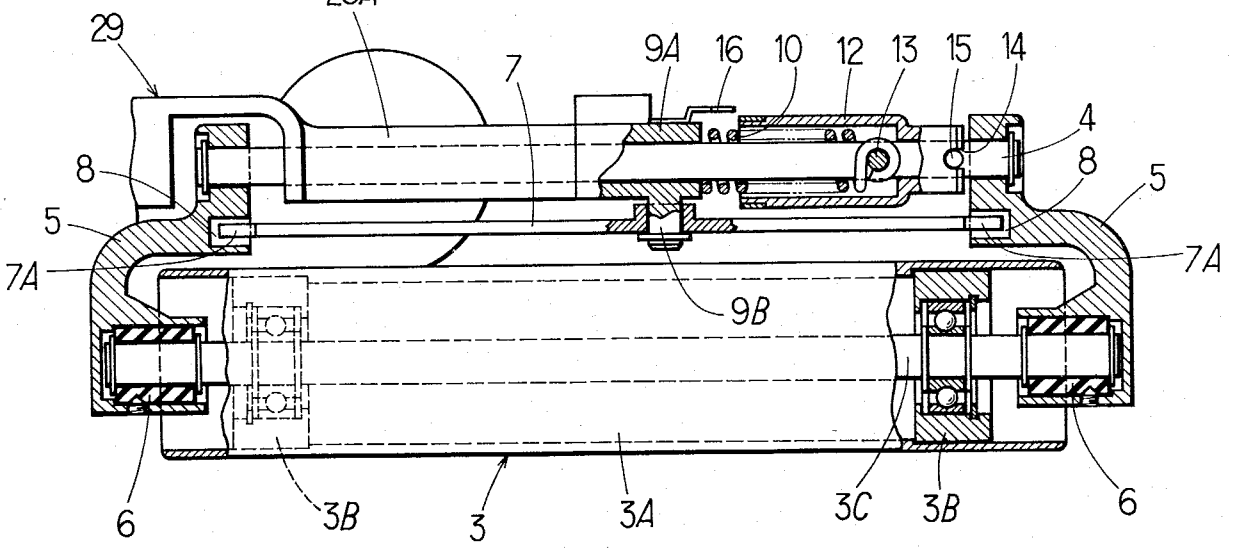
FIG. 3 is a front view partly broken away and showing the same.

As shown in greater detail in FIG. 3, the movable roller 3 comprises a tubular member 3A made of phenolic resin, a pair of bearing assemblies 3B fixedly fitted in the tubular member 3A, and a roller shaft 3C extending through the bearing assemblies 3B and rotatably supported at its opposite ends by bearings 6 on a pair of side arms 5.

Figure 6:
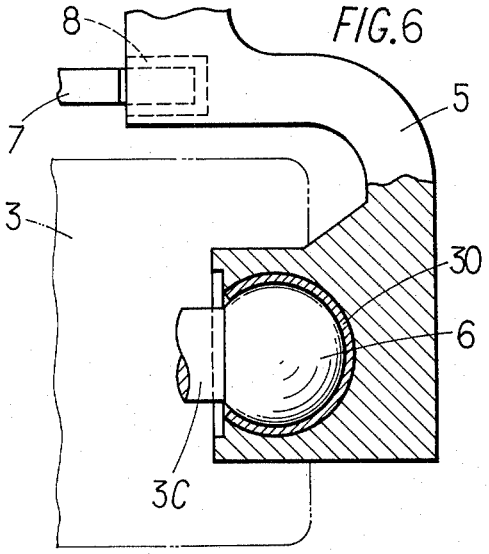
FIG. 6 is an enlarged sectional view showing a modified bearing for a movable roller shaft.

Each of the bearings 6 shown in FIG. 3 is a bush of rubber or like elastic material. Alternatively, the bearing may be spherical as seen in FIG. 6 and covered with a spherical seat member 30 of elastic material.

In either case, the tubular member 3A of the movable roller 3 is rotatable relative to the roller shaft 3C.

The pair of side arms 5 supporting the movable roller 3 are turnably supported by the opposite ends of an arm shaft 4 disposed above the movable roller 3, so that the side arms 5, when turned about the shaft 4, move the movable roller 3 toward or away from the fixed roller 2.

Figure 7:
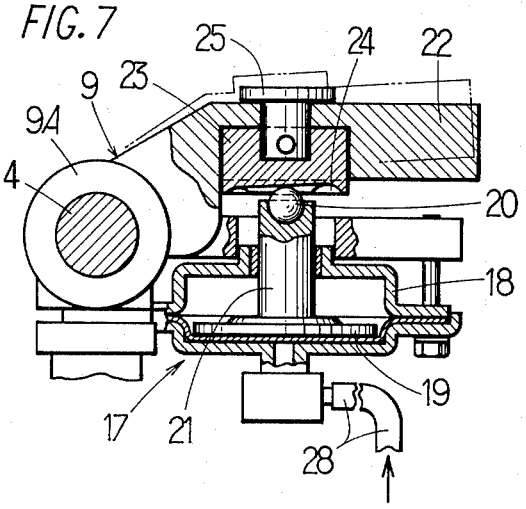
FIG. 7 is an enlarged sectional view showing a diaphragm cylinder serving as means for holding the movable roller away from a fixed roller.

As best seen in FIGS. 3 and 7, a center arm 9 has a boss portion 9A fitting around the arm shaft 4 at the middle of its length. At the midportion of the length of the movable roller 3, a pin 9B projects from the center arm boss portion 9A. A transmitting bar 7 is pivotably supported by the pin 9B (see FIG. 3).

The transmitting bar 7 is positioned between the arm shaft 4 and the movable roller 3 and extends in parallel therewith. The transmitting bar 7 is fitted, at each of its opposite ends 7A, in an engaging portion 8 formed at the base portion of each side arm 5, with a small clearance formed in the engaging portion 8 around the bar end 7A. Thus, the movable roller 3 can be inclined slightly relative to the fixed roller 2 within a range afforded by the clearance.

Accordingly, even when the parallel arrangement of the fixed roller 2 and the movable roller 3 involves some error, a travelling fabric can be nipped properly, while even if the fabric has slubs or like defects, the roller 3 can be positioned properly relative to the roller 2 for the desired nipping engagement with the fabric. This advantage results from the provision of the clearance and also partly from the elastic contraction of the bearings 6 in the form of a bush, or from the deformation of the spherical bearings shown in FIG. 6.

Figure 4:
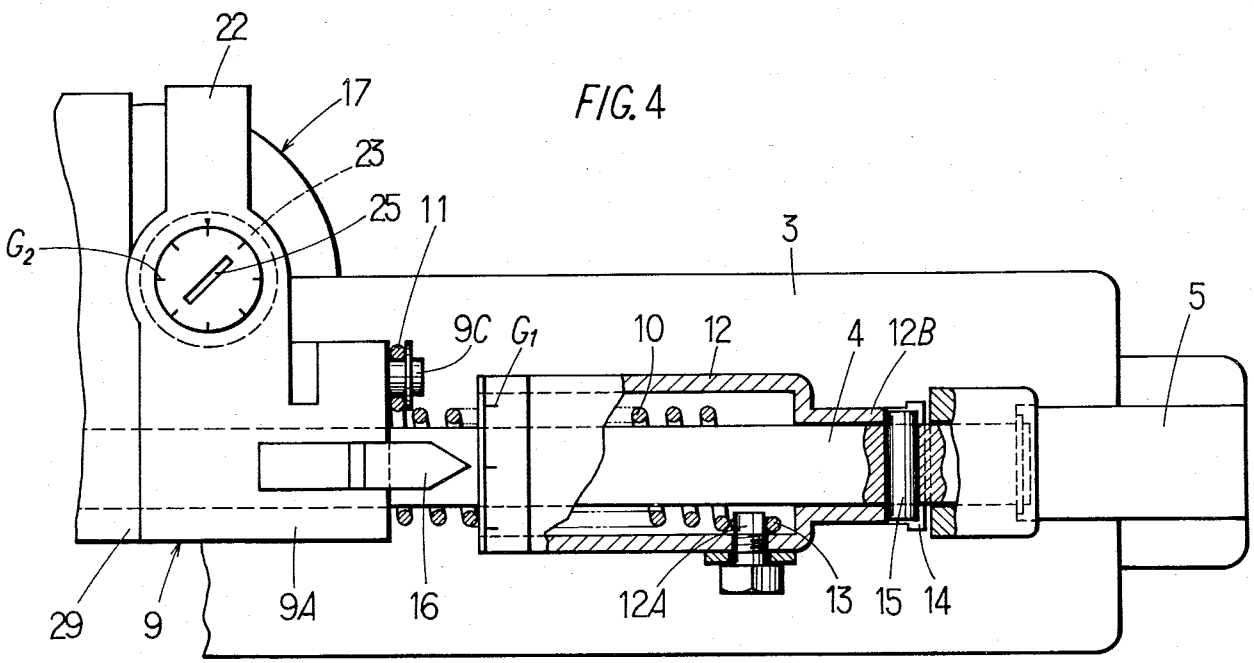
FIG. 4 is a plan view partly broken away and showing a spring and means for adjusting the resilience of the spring.
Figure 5:
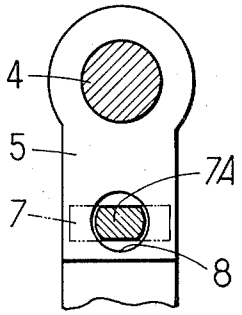
FIG. 5 is a sectional view on an enlarged scale showing a transmitting bar as installed in place.

The movable roller 3 is biased toward the fixed roller 2 by spring means 10 to nip the fabric with the fixed roller 2. The spring means 10 chiefly comprises a coiled spring wound around the arm shaft 4 and positioned closer to one end of the shaft 4. As seen in FIG. 4, the spring has one end attached as at 11 to a pin 9C fixed to the center arm 9 and the other end engaged as at 13 with a pin 12A on a tubular member 12 fitting around the arm shaft 4 for adjusting the resilience or force of the spring.

The spring force adjusting member 12 has a boss portion 12B rotatable on the arm shaft 4 in sliding contact therewith and formed in its end face with an engageable portion 14. An engaging portion 15 projecting from the arm shaft 4 is engageable with the portion 14 (see FIG. 4). Accordingly, when the portion 15 is in engagement with the portion 14, the adjusting member 12 is locked to the shaft 4 against rotation. If in this state the coiled spring has been so compressed as to accumulate a force therein, the restoring force of the spring will turn the boss portion 9A of the center arm 9, causing the transmitting bar 7 to bias the side arms 5 clockwise in FIG. 2 and elastically force the movable roller 3 against the fixed roller 2.

The engageable portion 14 formed in the adjusting member 12 comprises a plurality of cutouts arranged circumferentially of the member 12 at specified spacing. The engaging portion 15 in the form of a pin is engageable selectively in one of the diametrically opposed pairs of cutouts.

Accordingly, when the adjusting member 12 is grasped by the hand, then slidingly moved leftward in FIG. 4 to release the engageable portion 14 from the engaging portion 15 and thereafter turned on the arm shaft 4 in either direction to diametrically enlarge or contract the coiled spring 10, the magnitude of the force accumulated in the spring is adjustable.

With the force of the spring means 10 thus adjusted, the desired cutouts of the engageable portion 14 are brought into engagement with the engaging portion 15, whereby the movable roller 3 can be biased toward the fixed roller 2 by the adjusted force of the spring.

The adjusting member 12 is formed with graduations $G_1$ arranged circumferentially thereof in corresponding relation to the cutouts of the engageable portion 14, in combination with a pointer 16 on the center arm 9. The scale and the pointer 16 readily indicate the magnitude of the biasing force of the spring.

The force of the spring means 10 delivered through the transmitting bar 7 biases the movable roller 3 toward the fixed roller 2 at all times, thus rendering the roller 3 ready to nip the travelling fabric together with the roller 2.

Cylinder means 17, best shown in FIG. 7, acts to hold the movable roller 3 away from the fixed roller 2. In the illustrated embodiment, the means 17 is a diaphragm cylinder. A diaphragm 19 is provided at the junction between the opposed segments of a cylinder main body 18. A push rod 21 is mounted on the diaphragm 19 concentrically with the cylinder main body 18. A ball 20 is rollably fitted in the forward end of the push rod 21.

Figure 8:
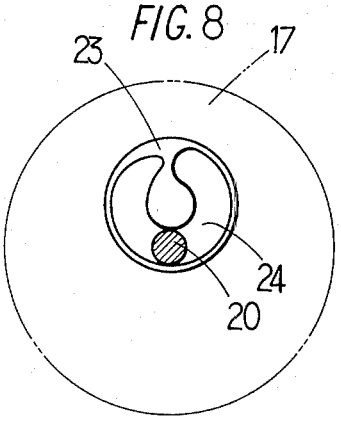
FIG. 8 is an enlarged view showing the under side of a cam for a push rod on the cylinder.
Figure 9:
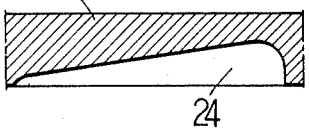
FIG. 9 is a development showing the cam in section.

On the other hand, a lever 22 extends from the center arm 9 at right angles therewith. A dish-shaped cam 23 attached to the inner side of the lever 22 has a circular arc slanting groove 24 formed in its under side. The ball 20 on the push rod 21 is engaged in the cam groove 24 (see FIGS. 8 and 9).

When air is supplied to the interior of the diaphragm cylinder 17 to advance the push rod 21, the cam 23 pushes the lever 22 toward the broken-line position shown in FIG. 7, thereby turning the center arm 9 on the arm shaft 4 counterclockwise in FIG. 7. The turn of the arm 9 causes the transmitting bar 7 to turn the side arms 5 counterclockwise, whereby the movable roller 3 is moved away from the fixed roller 2.

Further as shown in FIGS. 4 and 7, a knob 25 is provided on the outer side of the cam 23 at its center. The knob 25, when turned, shifts the ball 20 relative to the cam groove 24 to adjust the depth of engagement of the ball 20 in the cam groove 24 and to thereby adjust the distance of advance of the push rod 21, whereby the spacing between the fixed roller 2 and the movable roller 3 is adjustable to render the apparatus suitably usable for fabrics of varying thicknesses.

FIG. 4 shows graduations $G_2$ formed in a circular arrangement at predetermined spacing. This scale in combination of the knob 25 serving as a pointer indicates the degree of the adjustment.

Figure 10:
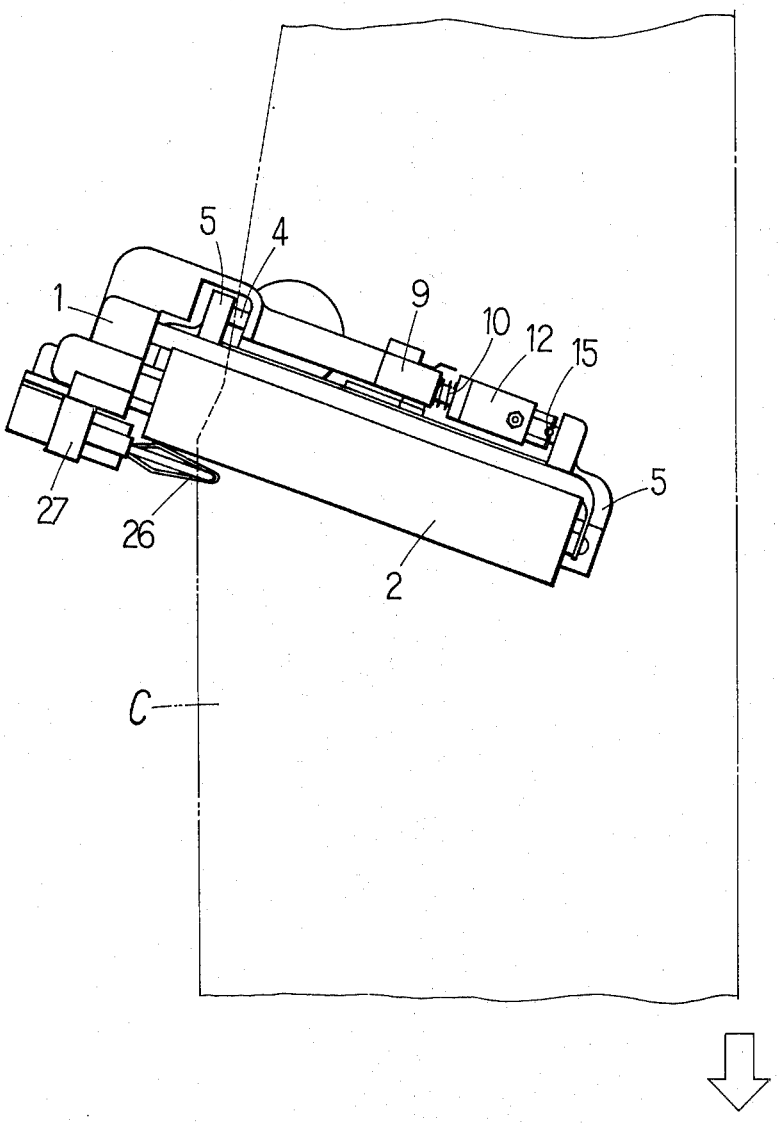
FIG. 10 is a diagram showing the embodiment in use for a travelling fabric.

FIG. 10 shows means 26 for detecting the selvage of the fabric which means is mounted on the frame 1 and positioned close to the location where the two rollers 2 and 3 are opposed to each other, the means 26 being disposed on one side of the apparatus where the fabric C is sent out from the apparatus. The detecting means 26 shown is a feeler which is usually held in position by an unillustrated spring. The detecting means 26 is operatively connected to known air valve means which is housed in a valve box 27 shown in FIG. 10.

The valve box 27 is in communication with an unillustrated compressor. When the valve means is opened, compressed air is fed through an air duct 28 (FIG. 7) to the cylinder means 17, while when the valve means is closed, the supply of air is interrupted, whereupon the spring means 10 forces the movable roller 3 toward the fixed roller 2.

When the fabric C travelling between the fixed roller 2 and the movable roller 3 and shown in FIG. 10 deviates with one selvage thereof moving away from the rollers, the means 26 detects the deviation and closes the valve means to stop the supply of compressed air from the compressor to the cylinder means 17.

This releases the lever 22 from the pressure of the push rod 21, immediately permitting the movable roller 3 to move toward the fixed roller 2 under the action of the spring means 10. Consequently the two rollers nip the selvage of the travelling fabric with high sensitivity or responsiveness, guiding the fabric C to the proper position for the correction of the deviation.

When the selvage has returned to the normal position, the detecting means 26 opens the valve means, which supplies pressurized air from the compressor to the cylinder means 17. The air inflates the diaphragm 19, which in turn advances the push rod 21. The ball 20 on the forward end of the rod 21 pushes up the lever 22 against the force of the spring means 10, whereby the movable roller 3 is brought away from the fixed roller 2 to release the fabric from nipping engagement and provide the specified distance between the two rollers.

Although not shown in FIG. 10, another like apparatus is disposed for the other selvage of the travelling fabric. Thus, one pair of opposed rollers cooperates with the other pair to correct the deviation of the fabric by a nipping action which is afforded with high sensitivity at all times by a highly responsive spring force.

As seen in FIG. 3, the arm shaft 4 is partly sheathed with a boss portion 29A of a support arm 29 extending from the frame 1.

While the present invention has been described above with reference to the illustrated embodiment, various changes and modifications can be made without departing from the scope of the invention defined in the appended claims.

For example, the diaphragm cylinder is replaceable by some other cylinder means which is operable by a pressure fluid, such as oil, other than air. A photo cell is usable as the selvage detecting means in place of the feeler.

What I claim is:

1. An apparatus for correcting the deviation of a travelling fabric comprising a fixed roller and a movable roller disposed in opposed relation to the fixed roller and movable toward and away from the fixed roller to correct the deviation of the fabric by nipping the fabric when necessary, the apparatus being characterized in that the movable roller is biased by spring means toward the fixed roller for nipping the fabric with the rollers, the movable roller being normally biased away from the fixed roller by cylinder means movable forward and backward by means for detecting a selvage of the fabric, and further comprising a pair of side arms for rotatably supporting the movable roller at the opposite ends of its shaft, an arm shaft disposed in parallel to the movable roller and supporting the side arms, a center arm fitting around the arm shaft, and a transmitting bar fitting in and extending between the side arms and pivoted at the midportion of its length to the center arm, the cylinder means and the spring means being coupled to the center arm to move the movable roller toward and away from the fixed roller through the transmitting bar.

2. An apparatus as defined in claim 1 wherein the spring means is provided with means for adjusting the magnitude of the force of the spring means.

3. An apparatus as defined in claim 2 wherein the force adjusting means comprises a tubular adjusting member rotatably fitting around the arm shaft, an engageable portion formed in the adjusting member, and an engaging portion provided on the arm shaft.

4. An apparatus as defined in claim 1 wherein the cylinder means is provided with means for adjusting the stroke of the cylinder means.

5. An apparatus as defined in claim 4 wherein the stroke adjusting means comprises a cam attached to a lever on the center arm and having a groove, a ball engaged in the cam groove and disposed at the forward end of a push rod of the cylinder means, and means for shifting the cam groove relative to the ball to adjust the stroke.

6. An apparatus as defined in claim 1 including means permitting the axis of the movable roller to be slightly inclined relative to the axis of the fixed roller.

7. An apparatus as defined in claim 1 wherein each end of the transmitting bar is engaged in the corresponding side arm with a clearance formed in the side arm around the bar end and resilient bearing means supporting the movable roller shaft in the side arms to permit the axis of the movable roller to slightly incline relative to the axis of the fixed roller.

8. An apparatus for correcting the deviation of a travelling fabric comprising a fixed roller and a movable roller disposed in opposed relation to the fixed roller and movable toward and away from the fixed roller to correct the deviation of the fabric by nipping the fabric when necessary, spring means for biasing the movable roller toward the fixed roller for nipping the fabric with the rollers, cylinder means for normally biasing the movable roller away from the fixed roller, said cylinder means being movable forward and backward by means for detecting a selvage of the fabric, a pair of side arms for rotatably supporting the movable roller at the opposite ends of its shaft, an arm shaft disposed in parallel to the movable roller and supporting the side arms, a center arm fitting around the arm shaft, the cylinder means being provided with means for adjusting the stroke of the cylinder means, and the stroke adjusting means comprising a cam attached to a lever on the center arm and having a groove, a ball engaged in the cam groove and disposed at the forward end of a push rod of the cylinder means, and means for shifting the cam groove relative to the ball to adjust the stroke.

* * * * *